United States Patent [19]

Li

[11] Patent Number: 4,941,612

[45] Date of Patent: Jul. 17, 1990

[54] UNIT FUEL INJECTOR

[75] Inventor: Xin-he Li, Higashimatsuyama, Japan

[73] Assignee: Diesel Kiki Co., Ltd., Tokyo, Japan

[21] Appl. No.: 395,432

[22] Filed: Aug. 17, 1989

[30] Foreign Application Priority Data

Sep. 1, 1988 [JP] Japan ..... 63-216350

[51] Int. Cl.[5] ..... F02M 55/02; F02M 57/02

[52] U.S. Cl. ..... 239/88; 239/124; 239/585

[58] Field of Search ..... 239/88, 89, 90, 91, 239/92, 93, 94, 95, 124, 585

[56] References Cited

U.S. PATENT DOCUMENTS

| | | | |
|---|---|---|---|
| 4,392,612 | 7/1983 | Deckard et al. | 239/88 |
| 4,408,718 | 10/1983 | Wich | 239/88 |
| 4,463,900 | 8/1984 | Wich | 239/88 |
| 4,470,545 | 9/1984 | Deckard et al. | 239/88 |
| 4,485,969 | 12/1984 | Deckard et al. | 239/88 |
| 4,527,737 | 7/1985 | Deckard | 239/89 |
| 4,618,095 | 10/1986 | Spoolstra | 239/90 |
| 4,653,455 | 3/1987 | Eblen et al. | 239/88 |
| 4,674,461 | 6/1987 | Hiyama et al. | 239/95 |

FOREIGN PATENT DOCUMENTS 63-73570 5/1988 Japan .

*Primary Examiner*—Andres Kashnikow
*Assistant Examiner*—Michael J. Forman

[57] ABSTRACT

A unit fuel injector includes a body. The body incorporates a pump mechanism, an injection nozzle mechanism for injecting fuel fed thereto from the pump mechanism, and an electromagnetic valve mechanism for relieving high pressure fuel from the pump mechanism. The electromagnetic valve mechanism includes a poppet-type valve member. Immediately when an abutment portion of the valve member is disengaged from a valve seat during a pump stroke, the pressurized fuel is spilled into a spill chamber from the pump mechanism. The fuel injector further includes a mechanism for propelling the valve member in such a direction that said abutment portion is moved away from the valve seat, utilizing the spill fuel pressure. The propelling mechanism includes a bore formed in said body, and a flange provided on a stem portion of the valve member, the flange being slidably fitted in the bore to divide the bore into a pressure introduction chamber and a low pressure chamber along the axis of the valve member. The pressure introduction chamber is connected to the spill chamber so as to receive the spill fuel pressure in the spill chamber whereas the low pressure chamber is connected to a low pressure source disposed exteriorly of the body. With this construction, the valve member is propelled in such a direction that said abutment portion is moved away from the valve seat due to a pressure differential across the flange when the pressure introduction chamber receives the spill fuel pressure.

6 Claims, 4 Drawing Sheets

UNIT FUEL INJECTOR

BACKGROUND OF THE INVENTION

1. Field of the Invention

This invention relates to a unit fuel injector for use in an internal combustion engine such as a diesel engine.

2. Prior Art

A unit fuel injector comprises a pump mechanism and an injection nozzle mechanism both of which are incorporated in an injector body, the unit fuel injector being mounted on an engine. The pump mechanism includes a cylinder bore formed in the body, and a plunger received in the cylinder bore for reciprocal movement there along. A pump chamber is defined by the cylinder bore and the plunger. The volume of the pump chamber is reduced during an advance or pump stroke of the plunger, and is increased during a return or suction stroke of the plunger. The injection nozzle mechanism includes an injection port in communication with the pump chamber, and a valve disposed between the pump and the injection port. When the pressure of fuel within the pump chamber is increased to a high level during the pump stroke of the plunger, the valve is opened to inject the fuel from the injection port. The unit fuel injector is also provided with a fuel relief control mechanism by which the relief of the fuel pressure within the pump chamber is controlled during the pump stroke of the plunger so as to control the timing of starting the fuel injection and the timing of terminating the fuel injection. As one example of such fuel relief control mechanism, an electromagnetic valve mechanism has been proposed.

U.S. Pat. No. 4,674,461 discloses a unit fuel injector provided with such an electromagnetic valve mechanism. More specifically, there is provided a relief passage communicating at one end with a pump chamber, the other end of the relief passage being opened and closed by a needle-type valve member of an electromagnetic valve. In this conventional unit fuel injector, during the time when the fuel injection is being effected, with the relief passage closed, the valve member is subjected to a very high fuel pressure. Therefore, to cope with such a high fuel pressure, an associated solenoid is required to produce a sufficiently great force for holding the valve member in its closed position.

U.S. Pat. Nos. 4,392,612, 4,463,900, 4,485,969, 4,527,737 and 4,618,095 also describe unit fuel injectors incorporating an electromagnetic valve mechanism. More specifically, such a fuel injector includes a guide hole and a spill chamber both of which are formed in a body of the fuel injector and communicate with each other. A valve seat is formed on one end surface of the guide hole facing the spill chamber. The electromagnetic valve mechanism also includes a poppet-type valve member which has a stem portion and a head (abutment portion) formed at one end of the stem portion. The stem portion has a reduced diameter portion disposed adjacent to the head, and is slidably received in the guide hole, so that an annular space is formed between the reduced diameter portion and the inner peripheral surface of the guide hole. This annular space is in communication with a pump chamber. The head of the valve member is disposed within the spill chamber and is movable into and out of contact with the valve seat. The electromagnetic valve mechanism further includes a solenoid drive means for controlling the movement of the valve member. The solenoid drive means comprises an armature connected to the other end of the stem portion of the valve member, a solenoid for driving the armature to move the same toward the valve seat together with the valve member so that the head of the valve member abuts against the valve seat, and a spring for urging the valve member in a direction away from the valve seat. The armature is mounted within an armature chamber formed in the fuel injector body.

In the above conventional unit fuel injector, when the solenoid is energized during the pump stroke of the plunger, the head of the valve member is brought into engagement with the valve seat, so that the communication of the spill chamber with the pump chamber is interrupted. As a result, the fuel within the pump chamber is pressurized and is injected from an injection nozzle mechanism. At this time, the fuel pressure is applied to the opposed shoulders formed respectively on the opposite ends of the reduced diameter portion of the valve member, so that the forces acting respectively on these opposed shoulders cancel each other. Therefore, the force required to be produced by the solenoid so as to hold the valve member in its closed position can be relatively small. When the solenoid is de-energized during the pump stroke of the plunger, the head of the valve member is brought out of engagement with the valve seat under the influence of the spring, so that the fuel of high pressure within the pump chamber is spilled to the spill chamber. As a result, the pressure within the pump chamber decreases, thus terminating the fuel injection operation.

At the moment when the valve member is disengaged from the valve seat so as to terminate the fuel injection operation as described above, the pressure within the spill chamber becomes high, and the valve member is urged by this high pressure toward the valve seat. As a result, the speed of disengagement of the valve member from the valve seat under the influence of the spring may become slower, or the valve member may be instantaneously moved back toward the valve seat. This results in a problem that the area of flow between the valve seat and the valve member can not be increased quickly, so that the pressure drop in the pump chamber is retarded. As a result, the fuel injection operation fails to be completely terminated at a time, and the problem of subsequent dripping of the fuel is encountered.

In order to overcome this problem, the above-mentioned U. S. patents have proposed the following procedure. Specifically, the spill chamber is communicated with the armature chamber by a passage, formed in the valve member, and/or a passage formed in the body. With this arrangement, the pressure of the above-mentioned spill fuel is applied not only to the spill chamber but also to the armature chamber, so that substantially the same pressure acts on both of the opposite ends of the valve member, thereby canceling the forces acting on the valve member in opposite axial directions of the valve member.

A fuel injector disclosed in U.S. Pat. No. 4,470,545 is provided with means by which the spill fuel pressure serves to accelerate the movement of a valve member away from a valve seat when the valve member is moved in its opening direction. More specifically, the valve member has a second stem portion extending from its head away from the valve seat, and the second stem portion has a flange intermediate opposite ends thereof. A slide hole is formed in the body of the fuel injector adjacent to a spill chamber, and an auxiliary chamber is formed in the body adjacent to one end of the slide hole remote from the spill chamber. The slide hole is smaller in diameter than the spill chamber and the auxiliary chamber. The flange of the valve member is slidably received in the slide hole. A passage is formed in the valve member, and has a first portion communicating the spill chamber with the armature chamber to achieve the above-mentioned pressure balance, and a second portion communicating the auxiliary chamber with the spill chamber and cooperating with the first portion to communicate the auxiliary chamber with the armature chamber.

With this conventional construction, immediately when the head of the valve member is disengaged from the valve seat, kinetic energy of the spill fuel flowing into the spill chamber is applied to the flange of the valve member so as to accelerate the movement of the valve member away from the valve seat. Actually, however, the amount of such spill fuel is small, and the kinetic energy obtained is also small, and therefore such acceleration effect has been found not satisfactory. Further, the spill fuel pressure is applied to one face or side of the flange facing the spill chamber when the valve member begins to move in its opening direction, and substantially simultaneously therewith, the spill fuel pressure is also transmitted to the other side of the flange facing the auxiliary chamber via the passage formed in the valve member. Therefore, the force produced by the spill fuel pressure so as to propel or move the valve member away from the valve seat is hardly effective.

SUMMARY OF THE INVENTION

It is therefore an object of this invention to provide a unit fuel injector in which a spill fuel pressure can propel a valve member away from a valve seat when a fuel injection operation is terminated, thereby finishing the fuel injection operation at a time without delay.

According to the present invention, there is provided a unit fuel injector comprising:

(a) a body;

(b) pump means mounted on the body and including a cylinder hole formed in the body, and a plunger received in the cylinder hole so as to be reciprocally movable along the cylinder hole to achieve a pump stroke and a suction stroke, a pump chamber being defined by the cylinder hole and the plunger;

(c) injection nozzle means mounted on the body and including an injection port connected to the pump chamber, and an injection valve for controlling the communication between the injection port and the pump chamber, the injection valve being opened upon increase of the pressure within the pump chamber to a predetermined level, thereby injecting fuel from the injection port;

(d) electromagnetic valve means mounted on the body and including a guide hole formed in the body, and a spill chamber formed in the body and connected to the guide hole, a valve seat being provided between the guide hole and the spill chamber, the electromagnetic valve means further including a valve member received in the guide hole for sliding movement there along, and a solenoid drive means for controlling the movement of the valve member, the valve member having a stem portion and an abutment portion formed on the stem portion and disposed in the spill chamber, the stem portion having a reduced diameter portion adjacent to the abutment portion, an annular space being defined by the reduced diameter portion and an inner peripheral surface of the guide hole, the spill chamber being connected to the pump chamber via the annular space, the valve member being movable between a first position where the abutment portion is held away from the valve seat and a second position where the abutment portion is held against the valve seat, the communication between the spill chamber and the pump chamber being interrupted when the valve member is moved from the first position to the second position during the pump stroke, thereby increasing the pressure within the pump chamber to start the injection of the fuel from the injection port, and the spill chamber and the pump chamber being communicated with each other via the annular space when the valve member is moved from the second position to the first position during the pump stroke, so that the fuel of high pressure within the pump chamber is spilled to the spill chamber to thereby terminate the fuel injection; and (e) means for propelling the valve in such a direction that the abutment portion is moved away from the valve seat, the propelling means including a bore formed in the body, and a flange provided on an outer periphery of the stem portion of the valve member, the flange being slidably fitted in the bore to divide the bore into a pressure introduction chamber and a low pressure chamber along the axis of the valve member, the pressure introduction chamber being connected to the spill chamber so as to receive the spill fuel pressure in the spill chamber, the low pressure chamber being connected to a low pressure source disposed exteriorly of the body, the pressure of the low pressure source being lower than the spill fuel pressure, whereby the valve member is propelled in a direction away from the valve seat due to a pressure differential across the flange when the pressure introduction chamber receives the spill fuel pressure.

DESCRIPTION OF THE PREFERRED EMBODIMENTS OF THE INVENTION

A preferred embodiment of the prevent invention will now be described with reference to FIGS. 1 and 2.

Figure 1:
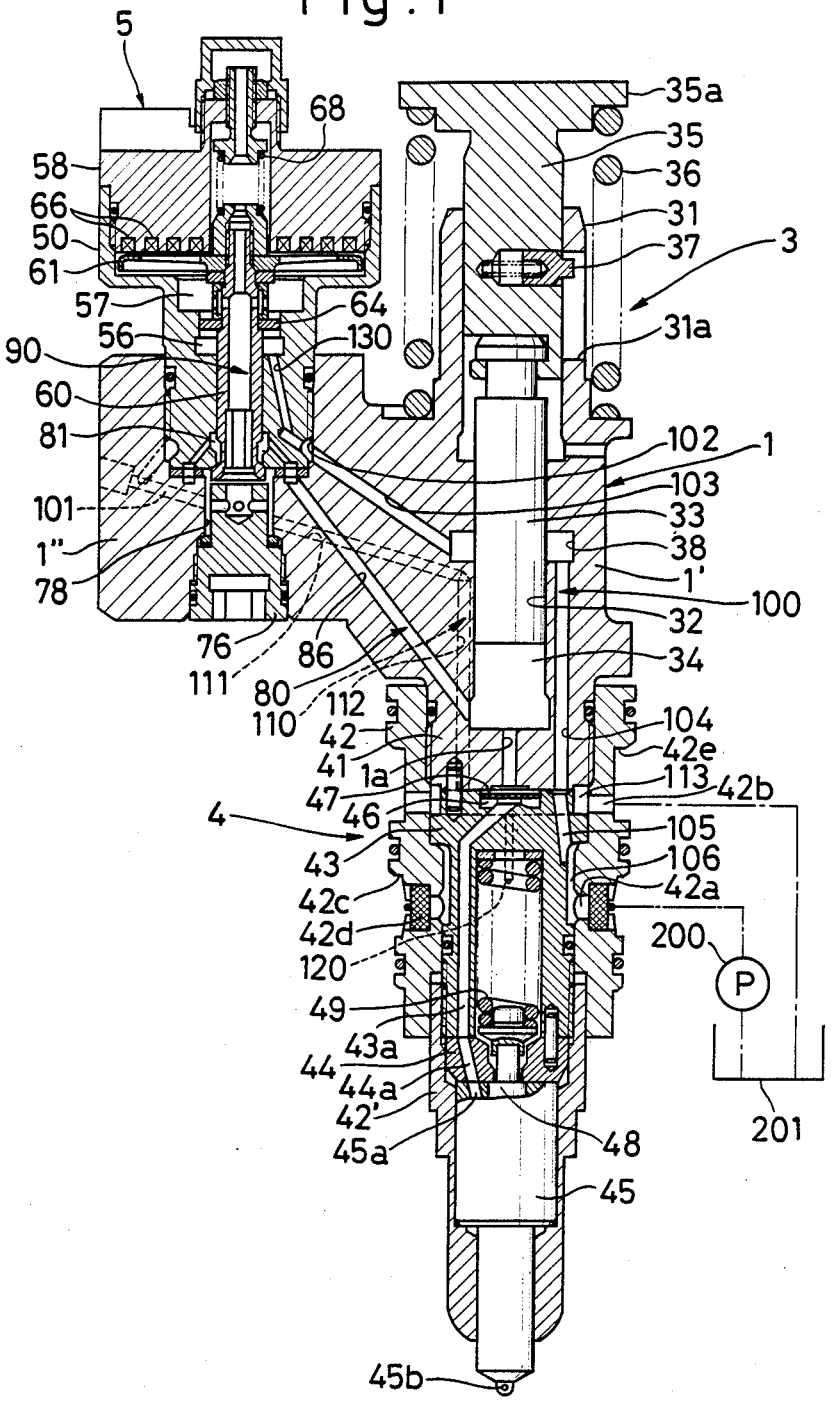
FIG. 1 is a vertical cross-sectional view of a unit fuel injector provided in accordance with the present invention.
Figure 2:
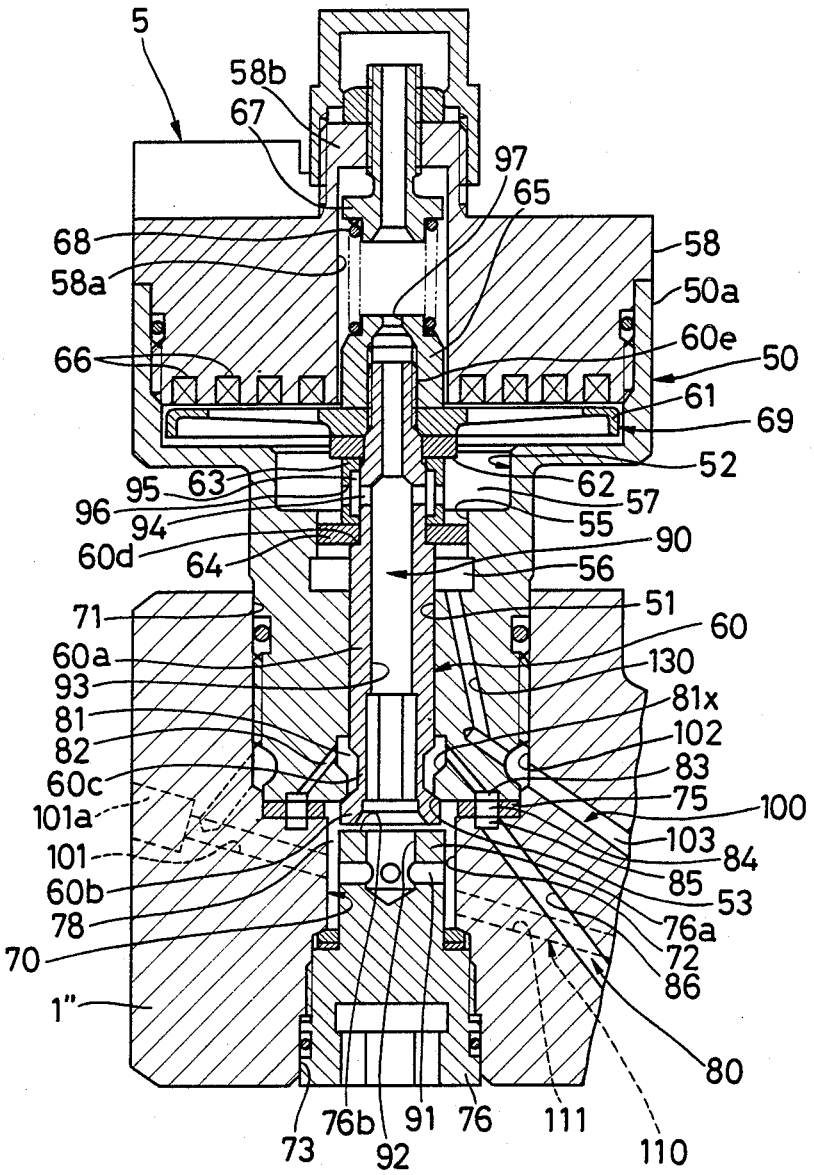
FIG. 2 is an enlarged vertical cross-sectional view of an important portion of the unit fuel injector.

A unit fuel injector shown in FIGS. 1 and 2 comprises a body 1 which has a vertical base body portion 1' and a side body portion 1'' disposed in juxtaposed relation to the base body portion 1'. The base body portion 1' incorporates a pump mechanism 3 for pressurizing fuel and an injection nozzle mechanism 4 for injecting the thus pressurized fuel into a cylinder of an engine. The side body portion 1'' incorporates an electromagnetic valve mechanism 5 for controlling the timing of starting the fuel injection and the timing of terminating the fuel injection.

First, the pump mechanism 3 will now be described in detail. The base body portion 1' has a tubular portion 31 extending vertically upwardly from the upper side of the portion 1', and a cylinder hole 32 formed in the base body portion 1' in coaxial relation to the tubular portion 31. The diameter of the cylinder hole 32 is smaller than the inner diameter of the tubular portion 31, and the cylinder hole 32 is enlarged in diameter at its lower end. A plunger 33 is received in the cylinder hole 32 so as to be reciprocally movable there along, the plunger 33 extending into the tubular portion 31. The lower end face of the plunger 33 defines, together with the cylinder hole 32, a pump chamber 34. As the plunger 33 is moved downward (an advance or pump stroke), the volume of the pump chamber 34 is reduced so as to pressurize the fuel in the pump chamber 34. As the plunger 33 is moved upward (a return or suction stroke), the volume of the pump chamber 34 is increased so as to introduce the fuel into the pump chamber 34 by suction.

A follower member 35 is received in the tubular portion 31 for sliding movement there along. The lower end of the follower member 35 is connected to the upper end of the plunger 33. The follower member 35 has at its upper end an enlarged diameter portion 35*a*. The follower member 35 is urged upward by a coil spring 36 acting between the enlarged diameter portion 35*a* and the upper surface of the body 1, so that the follower member 35 is always held in contact with a cam portion of a cam shaft rotated by an engine (not shown). In response to the rotation of the cam shaft, the follower member 35 is moved upward and downward together with the plunger 33. A limit member 37 is secured to the follower member 35 and is slidably received in a vertical slot 31*a* formed through the tubular portion 31. The limit member 37 is brought into engagement with the upper end of the slot 31*a* to limit the upward movement of the follower member 35 and hence to prevent the follower member 35 from becoming disengaged upwardly from the tubular portion 31.

A leakage prevention groove 38 of an annular shape is formed in the central portion of the inner peripheral surface of the cylinder hole 32, and serves to prevent the fuel, contained in the pump chamber 34, from leaking to the exterior through a gap between the inner peripheral surface of the cylinder hole 32 and the outer peripheral surface of the plunger 33.

Next, the injection nozzle mechanism 4 will now be described in detail. The base body portion 1' has at its lower end portion an projection 41 extending vertically downwardly in coaxial relation to the tubular portion 31. A tubular retainer 42 is threadedly connected at its upper end to the projection 41. A spring holder 43 is received within the retainer 42. An auxiliary retainer 42' is threadedly connected to the lower end of the spring holder 43. A spacer 44 is received in the auxiliary retainer 42', and an injection nozzle 45 is inserted into the auxiliary retainer 42'. The projection 41, the spring holder 43, the spacer 44 and the injection nozzle 45 are held in intimate contact with one another by threadedly tightening the retainer 42 and the auxiliary retainer 42' relative to the projection 41 and the spring holder 43, respectively. The retainer 42 is received in a hole, formed in a cylinder head of the engine, through a sleeve (not shown), and the distal or lower end of the injection nozzle 45 faces the cylinder of the engine.

The injection nozzle 45 has at its distal end injection ports 45*b*. The injection ports 45*b* are in communication with the pump chamber 34 via a passage 45*a* in the injection nozzle 45, a passage 44*a* in the spacer 44, a passage 43*a* in the spring holder 43 and a passage 1*a* in the base body portion 1'.

A valve receiving chamber 46 is formed in the upper surface of the spring holder 43, and a disc-shaped check valve 47 is received within the valve receiving chamber 46 and serves to prevent the flow of the fuel from the passage 45*a* of the injection nozzle 45 to the pump chamber 34.

A needle valve 48 is slidably received in the injection nozzle 45. The needle valve 48 is urged downwardly by a coil spring 49, mounted within the spring holder 43, so as to close the injection ports 45*b*. The needle valve 48 has a pressure receiving portion (not shown) intermediate opposite ends thereof. This pressure receiving portion is disposed in an oil reservoir chamber (not shown) provided at a mid portion of the passage 45*a* in the injection nozzle 45. The needle valve 48 receives the fuel pressure from the pump chamber 34 through this pressure receiving portion, and when this fuel pressure exceeds a set pressure determined by the spring 49, the needle valve 48 rises or lifts against the bias of the spring 49, thereby opening the injection ports 45*b* to inject the fuel of high pressure.

Fuel inlet ports 42*a* and fuel outlet ports 42*b* are formed through the peripheral wall of the retainer 42. The fuel inlet ports 42*a* are in communication with a fuel supply pump 200 via an annular space formed between an annular stepped groove 42*c* in the outer peripheral surface of the retainer 42 and an inner peripheral surface of the above-mentioned sleeve surrounding the retainer 42, a communication passage formed in the sleeve, a communication passage (not shown) in the cylinder head and a pipe (not shown) connected to the cylinder head. Fuel in a fuel tank 201 is supplied to the fuel inlet ports 42*a* by the fuel supply pump 200 under a pressure of about 5 to 6 $Kg/cm^2$. A filter 42*d* is mounted in the annular groove 42*c*. The fuel outlet ports 42*b* are in communication with the fuel tank 201 via an annular space formed between an annular groove 42*e* in the outer peripheral surface of the retainer 42 and the inner peripheral surface of the sleeve surrounding the retainer 42, another communication passage in the sleeve, another communication passage (not shown) in the cylinder head and another pipe (not shown) connected to the cylinder head.

Next, the electromagnetic valve mechanism 5 and its associated parts will now be described in detail. As best shown in FIG. 2, a stepped bore 70 is formed through the side body portion 1'' and extends vertically from the upper surface to the lower surface of the side body portion 1''. The stepped bore 70 has an upper portion 71 of the largest diameter, an intermediate portion 72 of the smallest diameter, and a lower portion 73 slightly greater in diameter than the intermediate portion 72.

The electromagnetic valve mechanism 5 is provided as a unit, and a lower portion of this unit is received in the upper portion 71 of the stepped bore 70. The electromagnetic valve member 5 comprises a tubular housing 50 which has a guide hole 51 extending along the axis of the housing 50 and opening to the lower surface of the housing 50. The housing 50 also has a stepped bore 52 extending upwardly from the guide hole 51 in coaxial relation thereto and opening to the upper surface of the housing 50. That portion of the inner peripheral surface of the guide hole 51 which defines the lower end of the guide hole 51 serves as a valve seat 53 of a tapered shape which increases in diameter progressively toward its lower end. The stepped bore 52 has a portion 55 disposed intermediate the opposite ends thereof and spaced from the upper end of the guide hole 51, the portion 55 serving as a slide hole. The stepped bore 52 also has a lower portion 56 disposed between the slide hole 55 and the guide hole 51, the lower portion 56 serving as a low pressure chamber. An upper stepped portion 57 of the stepped bore 52 extending upwardly from the slide hole 55 serves as an armature chamber (pressure introduction chamber). The upper tubular portion 50*a* of the housing 50 is enlarged in diameter, this tubular portion 50*a* defining part of the armature chamber 57. A stator 58 is threaded into the tubular portion 50*a* to close the armature chamber 57. The housing 50 and the stator 58 constitute part of the body 1.

A valve member 60 is slidably received in the guide hole 51 in the housing 50. The valve member 60 has a stem portion 60*a*, and a head 60*b* (abutment portion) which is formed at the lower end of the stem portion 60*a* and is greater in diameter than the stem portion 60*a*. The stem portion 60*a* has a reduced diameter portion 60*c* disposed adjacent to the head 60*b*. The head 60*b* of the valve member 60 projects downwardly from the lower surface of the housing 50, and a tapered surface of the head 60*b* is movable into and out of contact of the valve seat 53.

In downward sequence, a disc-shaped armature 61, a shim 62, a sleeve 63 and an annular flange member or collar 64 are mounted on the upper portion of the stem portion 60*a* of the valve member 60. The flange member 64 abuts against a step or shoulder 60*d* formed on the outer peripheral surface of the stem portion 60*a*. The armature 61, the shim 62, the sleeve 63 and the flange member 64 are tied together and fixed to the stem portion 60*a* by a nut 65 threaded on a threaded portion 60*e* formed on the upper end of the stem portion 60*a*.

The flange member 64 is fitted in a substantially liquid-tight manner in the slide hole 55 so as to be slidable along the axis of the slide hole 55. The flange member 64 interrupts the flow communication between the low pressure chamber 56 and the armature chamber 57. The armature 61, the shim 62 and the sleeve 63 are disposed within the armature chamber 57.

Solenoid coils 66 for attracting the armature 61 upwardly are embedded in the lower surface of the stator 58 facing the armature 61. The stator 58 has a central axial hole 58*a* opening at a lower end into the armature chamber 57. Thus, the axial hole 58*a* serves as part of the armature chamber 57. The upper end of the hole 58*a* is closed by an end wall 58*b*. The nut 65 is received in the lower portion of the hole 58*a*, and a spring retainer 67 is received in the upper portion of the hole 58*a* and is threaded into the end wall 58*b*. A coil spring 68 is disposed within the hole 58*a* and acts between the spring retainer 67 and the nut 65 so as to urge the armature 61 downwardly. The armature 61, the solenoid coils 66 and the spring 68 jointly constitute a solenoid drive means 69.

The timing of starting the energization of the solenoid coils 66 and the timing of terminating this energization are controlled by means of a control portion (not shown), constituted, for example, by a microcomputer, in accordance with the operating conditions of the engine, such as the engine speed and the load.

The lower portion of the housing 50 of the unit electromagnetic valve mechanism 5 is threaded into the upper portion 71 of the stepped bore 70 in the side body portion 1''. An annular spacer 75 is interposed between the lower end of the housing 50 and the bottom surface of the upper portion 71 of the stepped bore 70.

A closure member 76 is threaded into the lower portion 73 of the stepped bore 70. The closure member 76 has an upper portion 76*a* projecting into the intermediate portion 72 of the stepped bore 70, the upper portion 76*a* serving as a stop portion. An upper surface 76*b* of the stop portion 76*a* serves as a stop surface. The stop surface 76*b* is flat and is disposed in opposed relation to the flat lower end surface of the head 60*b* of the valve member 60. The downward movement of the head 60*b* of the valve member 60 is limited by the stop surface 76*b*.

A spill chamber 78 is defined by the inner peripheral surface of the intermediate portion 72 of the stepped bore 70, the inner peripheral surface of the spacer 75, the outer peripheral surface of the stop portion 76*a* of the closure member 76 and the lower end surface of the housing 50. The valve seat 53 is disposed immediately adjacent to the spill chamber 78, and the head 60*b* of the valve member 60 is disposed in the spill chamber 78.

The spill chamber 78 is disposed at an important point in the flow of the fuel in the fuel injector, and is in communication with the pump chamber 34, the armature chamber 57, the fuel inlet ports 42*a* and the fuel outlet ports 42*b*.

The spill chamber 78 will now be described in detail. The spill chamber 78 is in communication with the pump chamber 34 via a passage 80. The passage 80 has an annular space 81 formed by the reduced diameter portion 60*c* of the valve member 60 and an annular groove 81*x*, formed in the inner peripheral surface of the lower portion of the guide hole 51; a plurality of holes 82 formed in the lower end portion of the housing 50 and communicating at their one ends to the annular space 81; an annular groove 83 formed in the lower end surface of the housing 50 and communicating with the other ends of the holes 82; a plurality of holes 84 formed through the spacer 75; an annular groove 85 formed in the bottom surface of the upper portion 71 of the stepped bore 70; and a passage 86 formed in the body 1 and connected between the annular groove 85 and the pump chamber 34. The spill chamber 78 and the pump chamber 34 are communicated with each other via the passage 80 when the head 60*b* of the valve member 60 is spaced apart from the valve seat 53, and this communication is interrupted when the head 60*b* is held in contact with the valve seat 53.

The spill chamber 78 is in communication with the armature chamber 57 via a passage 90. The passage 90 has a plurality of transverse holes 91 formed in the stop portion 76*a* of the closure member 76 and opening at their one ends to the outer periphery surface of the stop portion 76*a*; an axial hole 92 formed in the stop portion 76*a* and extending from the other ends of the transverse holes 91 to the stop surface 76*b* of the stop portion 76*a*; an axial bore 93 extending axially through the valve member 60 from its upper to lower end thereof; a plurality of transverse holes 94 formed in the valve member 60 and communicating with the axial bore 93; an annular groove 95 formed in the inner peripheral surface of the sleeve 63 and communicating with the transverse holes 94; and transverse holes 96 formed through the peripheral wall of the sleeve 63 and communicating the annular groove 95 with the armature chamber 57. The passage 90 also has a hole 97 formed in the nut 65 and communicating the axial bore 93 of the valve member 60 with the hole 58*a* in the stator 58.

The spill chamber 78 is communicated with the fuel inlet ports 42*a* via a fuel supply passage 100. The fuel supply passage 100 has a generally L-shaped passage 101 formed in the body 1" and communicating at one end with the spill chamber 78; an annular groove 102 formed in the outer peripheral surface of the housing 50 adjacent to the lower end thereof; an oblique passage 103 formed in the body 1; the above-mentioned leakage prevention groove 38; an axial passage 104 formed in the body 1; an axial passage 105 formed in the spring holder 43; and an annular space 106 formed between the spring holder 43 and the retainer 42. The corner of the L-shaped passage 101 opens to the side of the body 1, and this one end is closed by a closure member 101*a*.

The spill chamber 78 is in communication with the fuel outlet ports 42*b* via a drain passage 110. The drain passage 110 has an oblique passage 111 formed in the body 1 and communicating at one end with the spill chamber 78, an axial passage 112 formed in the body 1, and an annular space 113 formed between the reduced-diameter upper portion of the spring holder 43 and the retainer 42. The interior of the spring holder 43 communicates with the annular space 113 via a bore 120 formed in the spring holder 43, so that the fuel leaking into the spring holder 43 can be discharged therefrom to the drain passage 110.

The low pressure chamber 56 of the electromagnetic valve mechanism 5 communicates with the annular groove 102 (which is part of the fuel supply passage 100) via a passage 130 formed in the housing 50 and therefore with the fuel supply pump 200.

In the construction illustrated, during the suction stroke of the plunger 33 of the pump mechanism 3, the volume of the pump chamber 34 is increased so that the fuel is introduced into the pump chamber 34 by suction. During the suction stroke of the plunger 33, the solenoid coils 66 of the electromagnetic valve mechanism 5 are not energized, so that the valve member 60 is held in its lower position where the head 60*b* of the valve member 60 is spaced apart from the valve seat 53 and is held at its lower surface against the stop surface 76*b* of the closure member 76.

In this condition, the fuel from the fuel supply pump 200 flows into the spill chamber 78 via the fuel supply passage 100, and further the fuel is supplied from the spill chamber 78 to the pump chamber 34 via the space between the head 60*b* of the valve member 60 and the valve seat 53 and the passage 80. Excess fuel is returned to the tank 201 via the drain passage 110 from the spill chamber 78.

During the supply of the fuel to the pump chamber 34, the fuel of such supply pressure is filled in the armature chamber 57 since the spill chamber 78 is in communication with the armature chamber 57 via the passage 90. Similarly, the fuel of the supply pressure is also filled in the low pressure chamber 56 communicating with the fuel supply passage 100 via the passage 130.

During the pump stroke of the plunger 33, the volume of the pump chamber 34 is reduced. At an initial stage of this pump stroke, the solenoid coils 66 are in their de-energized condition, so that the head 60*b* of the valve member 60 is spaced apart from the valve seat 53, and therefore the fuel in the pump chamber 34 is returned to the spill chamber 78 via the passage 80.

When the solenoid coils 66 are energized during the pump stroke of the plunger 33, the valve member 60 is moved upwardly against the bias of the spring 68, so that the tapered portion of the head 60*b* is brought into sealing engagement with the valve seat 53. As a result, the communication between the pump chamber 34 and the spill chamber 78 is interrupted, and as the volume of the pump chamber 34 decreases, the pressure of the fuel within the pump chamber 34 increases. When this fuel pressure exceeds the set pressure, the needle valve 48 of the injection nozzle mechanism 4 is lifted, so that the fuel is injected from the injection ports 45*b*.

As is clear from the foregoing description, the timing of starting the energization of the solenoid coils 66 substantially determines the timing of starting the fuel injection.

When the head 60*b* of the valve member 60 is held in contact with the valve seat 53, the fuel of high pressure is applied from the pump chamber 34 to the annular space 81. However, since the opposed steps or shoulders of the stem portion 60*a* disposed respectively at the opposite ends of the reduced diameter portion 60*c* have the same area (pressure receiving area), the forces acting respectively on these opposed shoulders in the axial direction of the valve member 60 cancel each other.

When the energization of the solenoid coils 66 is stopped during the pump stroke of the plunger 33, the valve member 60 is urged downwardly under the influence of the spring 68, so that the head 60*b* is moved away from the valve seat 53. At this moment, the fuel of high pressure within the pump chamber 34 is spilled or fed to the spill chamber 78 via the passage 80 and the space between the head 60*b* and the valve seat 53. As a result, the pressure within the pump chamber 34 is reduced, thereby terminating the fuel injection operation.

The pressure of the fuel spilled into the spill chamber 78 imparts to the valve member 60 a force tending to move the valve member 60 upwardly. However, this spill fuel pressure applied to the spill chamber 78 is transmitted or propagated at high speed to the armature chamber 57 via the passage 90, so that the fuel pressure within the armature chamber 57 imparts to the valve member 60 a force tending to move the valve member 60 downwardly. As a result, these two forces, resulting from the fuel pressure and acting on the valve member 60 in the opposite directions, cancel each other. Since the spill fuel pressure is propagated to the armature chamber 57 not only via a narrow space between the head 60*b* of the valve member 60 and the stop surface 76*b* but also via the holes 91 and 92 formed in the stop portion 76*a*, a high-speed propagation is possible.

During the above fuel spill operation, because of a pressure differential across the flange member 64, a force to propel the valve member 60 downward.(that is, a force to space the head 60*b* away from the valve seat 53) is applied to the valve member 60. More specifically, before the fuel spill operation, the fuel supply pressure within each of the armature chamber 57 and the low pressure chamber 56 is much lower than the above spill fuel pressure. During the fuel spill operation, as described above, the high spil fuel pressure is propagated to the armature chamber 57 and acts on the upper surface of the flange member 64. Although this fuel pressure is also applied to the annular groove 102 via the passage 101, this pressure mostly escapes toward the fuel supply pump 200 via the fuel supply passage 100 extending from the passage 103 to the fuel inlet ports 42*a*, and only part of the spill fuel pressure is propagated to the low pressure chamber 56. Therefore, the pressure acting on the lower surface of the flange member 64 is far lower than the pressure acting on the upper surface of the flange member 64, so that a downward force, resulting from such pressure difference, is imparted to the flange member 64, thereby propelling the valve member 60 downwardly.

A resistance to the flow from the spill chamber 78 to the low pressure chamber via the passage 101, the annular groove 102 and the passage 130 is greater than a resistance to the flow from the spill chamber 78 to the armature chamber 57 via the passage 90. Therefore, part of the spill fuel pressure reaches the low pressure chamber 56 later than the spill fuel pressure reaches the armature chamber 57. As a result, the downward propelling force applied by the spill fuel pressure to the valve member 60 can be increased.

As a result, because of the propelling force applied by the spill fuel pressure and the resilient force of the spring 68, the valve member 60 can be quickly moved downwardly so as to quickly disengage the head **60*b* from the valve seat 53. This abruptly reduces the pressure within the pump chamber 34, thereby terminating the high pressure fuel injection from the injection ports 45*b*** at a time without delay.

Figure 3:
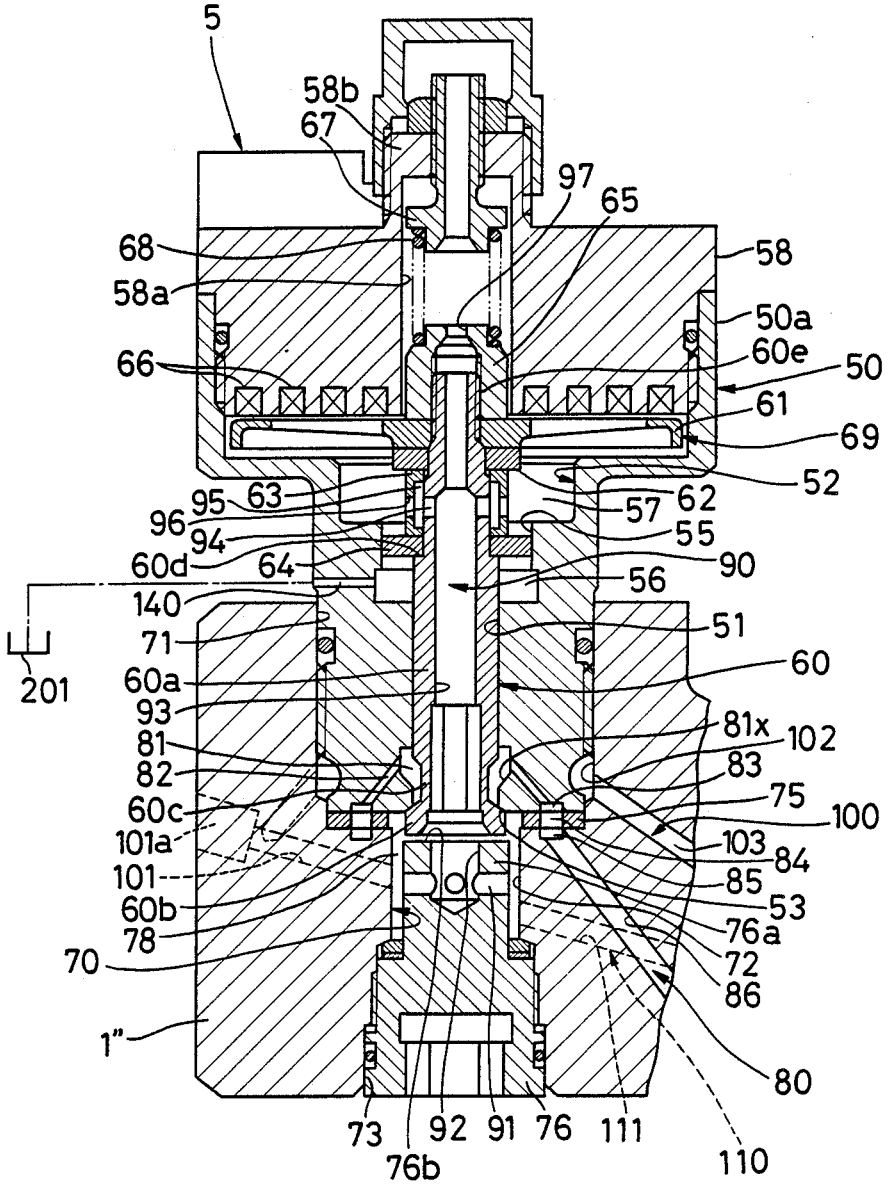
FIGS. 3 and 4 are enlarged vertical cross-sectional views of important portions of modified unit fuel injectors, respectively.

FIG. 3 shows a modified unit fuel injector according to the present invention. Those parts of this embodiment corresponding to those of the preceding embodiment of FIGS. 1 and 2 are denoted by the same reference numerals, respectively, and will not be described in detail here. In this embodiment of FIG. 3, the low pressure chamber 56 is not communicated with the fuel supply passage 100, and is communicated with the tank 201 via a transverse hole 140, formed in the housing 50, and a pipe (not shown). With this construction, the low pressure chamber 56 is not communicated with the spill chamber 78, and the lower surface of the flange member 64 is always subjected to the atmospheric pressure. Therefore, a pressure differential across the flange member 64 can be increased, and a greater downward propelling force can be applied to the valve member 60 when the valve member 60 is opened. If the fuel in the annular groove 81 leaks into the low pressure chamber 56 through a small gap between the outer peripheral surface of the valve member 60 and the inner peripheral surface of the guide hole 51, such leakage fuel is returned to the tank 201 via the transverse hole 140. The transverse hole 140 may not be connected to the fuel tank 201 but may be open to the ambient atmosphere.

Figure 4:
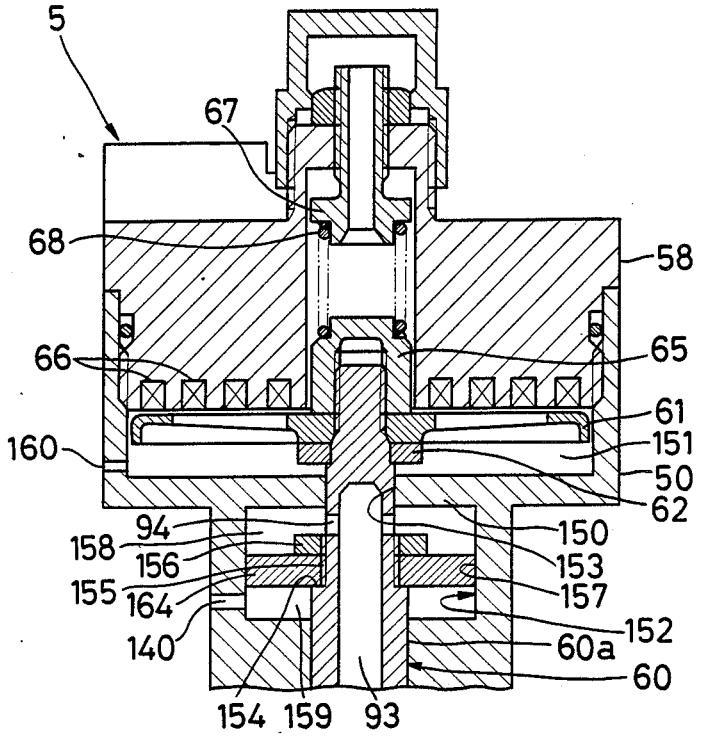

FIG. 4 shows another modified unit fuel injector according to the present invention. Those parts of this embodiment corresponding to those of the preceding embodiment of FIG. 3 are denoted by the same reference numerals, respectively, and will not be described in detail here. In this embodiment of FIG. 4, the housing 50 has a partition wall 150, and the internal space of the housing 50 is divided by the partition wall 150 into a first or upper chamber 151 and a second or lower chamber 152. An auxiliary slide hole 153 is formed through the partition wall 150, and the upper portion of the valve member 60 is slidably received in the auxiliary slide hole 153 in a substantially liquid-tight manner. The first chamber 151 serves as an armature chamber. The shim 62 and the armature 61, mounted on the upper end portion of the valve member 60 and fixed thereto by the nut 65, are disposed within the first chamber 151. A stepped portion 154 is formed on the outer peripheral surface of the valve member 60 intermediate the opposite ends thereof, and a threaded portion 155 is also formed on the outer peripheral surface of the valve member 60 adjacent to the stepped portion 154. A flange member 164 is clamped between the stepped portion 154 and a nut 156 threaded on the threaded portion 155. The flange member 164 is slidably fitted in a slide hole 157 defined by a mid portion of the second chamber 152. The flange member 164 divides the second chamber 152 into a pressure introduction chamber 158 and a low pressure chamber 159. The axial bore 93 in the valve member 60 does not extend upwardly through the valve member 60 and terminates at its upper end short of the upper end of the valve member 60. The transverse bores 94 communicates the axial bore 93 with the pressure introduction chamber 158.

In this embodiment of FIG. 4, during the fuel spill operation, the spill fuel pressure is propagated from the spill chamber 78 to the pressure introduction chamber 158 to create a pressure differential across the flange member 164. A difference between the area encircled by the outer periphery of the flange member 164 and the area encircled by the outer periphery of the stem portion **60*b* of the valve member 60 is sufficiently greater than the area encircled by the outer periphery of the stem portion 60*b*. Therefore, the downward force exerted on the flange member 164 by the spill fuel pressure is sufficiently greater than the upward force exerted on the valve member 60 by the spill fuel pressure. A difference between these two forces constitutes a propelling force to move the valve member 60 downwardly. Since the fuel is not introduced into the armature chamber 151, the armature is not subjected to a flow resistance of the fuel. Therefore, the valve member 60 has a good response to the energization and de-energization of the solenoid coils 66**.

In the embodiment of FIG. 4, preferably, a leakage hole 160 is formed through the peripheral wall of the housing 50. With this arrangement, the fuel is more positively prevented from filling in the armature chamber 151.

While the unit fuel injectors according to the present invention have been specifically shown and described herein, the invention itself is not to be restricted to the exact showing of the drawings and the description thereof. For example, the electromagnetic valve mechanism may be so modified that the valve member is urged by the spring toward the valve seat, and that the solenoid, when energized, moves the valve member away from the valve seat. Also, the flange member may be formed integrally with the valve member.

What is claimed is:

1. A unit fuel injector comprising:

(a) a body;

(b) pump means mounted on said body and including a cylinder hole formed in said body, and a plunger received in said cylinder hole so as to be reciprocally movable along said cylinder hole to achieve a pump stroke and a suction stroke, a pump chamber being defined by said cylinder hole and said plunger;

(c) injection nozzle means mounted on said body and including an injection port connected to said pump chamber, and an injection valve for controlling the communication between said injection part and said pump chamber, said injection valve being opened upon increase of the pressure within said pump chamber to a predetermined level, thereby injecting fuel from said injection port;

(d) electromagnetic valve means mounted on said body and including a guide hole formed in said body, and a spill chamber formed in said body and connected to said guide hole, a valve seat being provided between said guide hole and said spill chamber, said electromagnetic valve means further including a valve member received in said guide hole for sliding movement there along, and a solenoid drive means for controlling the movement of said valve member, said valve member having a stem portion and an abutment portion formed on said stem portion and disposed in said spill chamber, said stem portion having a reduced diameter portion adjacent to said abutment portion, an annular space being defined by said reduced diameter portion and an inner peripheral surface of said guide hole, said spill chamber being connected to said pump chamber via said annular space, said valve member being movable between a first position where said abutment portion is held away from said valve seat and a second position where said abutment portion is held against said valve seat, the communication between said spill chamber and said pump chamber being interrupted when said valve member is moved from said first position to said second position during said pump stroke, thereby increasing the pressure within said pump chamber to start the injection of the fuel from said injection port, and said spill chamber and said pump chamber being communicated with each other via said annular space when said valve member is moved from said second position to said first position during said pump stroke, so that the fuel of high pressure within said pump chamber is spilled to said spill chamber to thereby terminate the fuel injection; and (e) means for propelling said valve in such a direction that said abutment portion is moved away from said valve seat, said propelling means including a bore formed in said body, and a flange provided on an outer periphery of said stem portion of said valve member, said flange being slidably fitted in said bore to divide said bore into a pressure introduction chamber and a low pressure chamber along the axis of said valve member, said pressure introduction chamber being connected to said spill chamber so as to receive said spill fuel pressure in said spill chamber, said low pressure chamber being connected to a low pressure source disposed exteriorly of said body, the pressure of said low pressure source being lower than said spill fuel pressure, whereby said valve member is propelled in a direction away from said valve seat due to a pressure differential across said flange when said pressure introduction chamber receives said spill fuel pressure.

2. A unit fuel injector according to claim 1, in which said low pressure source comprises a fuel pump, said body having a fuel supply passage formed therein and communicating said fuel pump with said pump chamber, said low pressure chamber being communicated with said fuel supply passage.

3. A unit fuel injector according to claim 1, in which said low pressure source comprises a fuel tank, said body having a passage formed therein and communicating said fuel tank with said low pressure chamber.

4. A unit fuel injector according to claim 1, in which said low pressure source is the ambient atmosphere around said body, said body having a passage formed therein and communicating said low pressure chamber with the ambient atmosphere.

5. A unit fuel injector according to claim 1, in which said solenoid drive means comprises an armature, said armature being disposed within said pressure introduction chamber.

6. A unit fuel injector according to claim 1, in which said solenoid drive means comprises an armature, said body having an armature chamber within which said armature is disposed, and said armature chamber being isolated from said pressure introduction chamber.

* * * * *

UNITED STATES PATENT AND TRADEMARK OFFICE

CERTIFICATE OF CORRECTION

PATENT NO. : 4,941,612

DATED : July 17, 1990

INVENTOR(S) : Xin-he Li

It is certified that error appears in the above-identified patent and that said Letters Patent is hereby corrected as shown below:

In column 12, line 59, "injection part" should be --injection port--.

Signed and Sealed this

Twenty-seventh Day of April, 1993

*Attest:*

MICHAEL K. KIRK

*Attesting Officer*

*Acting Commissioner of Patents and Trademarks*